US007553186B2

(12) United States Patent
Morikawa et al.

(10) Patent No.: US 7,553,186 B2
(45) Date of Patent: Jun. 30, 2009

(54) FLUIDTIGHT CONNECTOR AND CONNECTOR ASSEMBLY

(75) Inventors: Satoshi Morikawa, Yokkaichi (JP); Takao Hata, Yokkaichi (JP); Tomonari Itou, Yokkaichi (JP)

(73) Assignee: Sumitomo Wiring Systems Ltd. (JP)

( * ) Notice: Subject to any disclaimer, the term of this patent is extended or adjusted under 35 U.S.C. 154(b) by 0 days.

(21) Appl. No.: 12/141,451

(22) Filed: Jun. 18, 2008

(65) Prior Publication Data

US 2008/0318473 A1 Dec. 25, 2008

(30) Foreign Application Priority Data

Jun. 19, 2007 (JP) ..... 2007-161165
Jun. 19, 2007 (JP) ..... 2007-161166

(51) Int. Cl.
*H01R 13/40* (2006.01)

(52) U.S. Cl. ..... 439/587

(58) Field of Classification Search ..... 439/586–589, 439/271–279, 281–282, 752, 382–385, 358, 439/680

See application file for complete search history.

(56) References Cited

U.S. PATENT DOCUMENTS 5,240,433 A * 8/1993 Kato ..... 439/587
5,618,206 A * 4/1997 Sawada et al. ..... 439/587
5,720,629 A * 2/1998 Self et al. ..... 439/587
7,066,747 B2 6/2006 Nagano et al.
7,311,546 B2 12/2007 Itou

* cited by examiner

*Primary Examiner*—Edwin A. Leon
(74) *Attorney, Agent, or Firm*—Gerald E. Hespos; Anthony J. Casella

(57) ABSTRACT

A watertight connector has a rubber member (40) mounted on an inner housing (13), and this rubber member (40) includes a sealing portion (41) substantially in the form of a tube fittable on the outer circumferential surface of the inner housing (13) before a flange (23), legs (43) integral to the sealing portion (41) and shaped to be insertable backward through pass-through openings (26), and backlash preventing portions (44) integral to the legs (43), shaped to be engageable with the peripheral edges of the pass-through openings (26) from behind and arranged between the flange (23) and a facing wall (32).

20 Claims, 9 Drawing Sheets

FLUIDTIGHT CONNECTOR AND CONNECTOR ASSEMBLY

BACKGROUND OF THE INVENTION

1. Field of the Invention

The invention relates to a fluidtight connector provided with a sealing member and to a connector assembly.

2. Description of the Related Art

U.S. Pat. No. 7,066,747 discloses a watertight connector with a seal for sealing between the watertight connector and a mating connector. The watertight connector has an inner housing and an outer housing is assembled to be relatively slidable in forward and backward directions along a connecting direction with the mating connector. A waterproof packing (seal) is mounted on the front end of the inner housing and is squeezed between the inner housing and a receptacle of the mating connector to provide sealing therebetween when the watertight connector is connected properly with the mating connector.

Two metallic coil springs are provided in the above-described connector to prevent backlash between the connectors due to vibration or the like. The coil springs are mounted between the inner and outer housings with the opposite ends thereof accommodated in spring accommodating holes formed in a rear part of the inner housing and in a rear wall of the outer housing. The coil springs are compressed between the inner and outer housings when the watertight connector is connected properly with the mating connector and the resilient restoring force of the springs biases the inner housing towards the mating connector. Thus, backlash between the connectors is suppressed and abrasion between terminals is prevented. However, this construction requires the coil springs for suppressing the backlash between the connectors in addition to the waterproof packing for sealing between the connectors, thereby presenting a problem of an increased number of parts.

U.S. Pat. No. 7,311,546 discloses a connector assembly for preventing backlash in a connected state. This connector assembly has first and second connectors that are connectable with each other. The first connector includes a receptacle that is open in a connecting direction with the second connector. The second connector includes a terminal holding portion that can fit into the receptacle. A tubular cover surrounds the terminal holding portion and fits on the receptacle. Terminals in the receptacle and terminals in the terminal holding portion are held connected when the two connectors reach a properly connected state.

First and second backlash preventing portions are provided at the front end of the terminal holding portion of the second connector and at the rear end of the cover of the second connector. The backlash preventing portions are held in contact with the receptacle to prevent backlash between the connectors in directions substantially orthogonal to the connecting direction when the connectors reach the properly connected state.

U.S. Pat. No. 7,066,747 discloses another connector assembly with a structure for preventing backlash in a connecting direction of the connector assembly. This connector assembly has first and second connectors connectable with each other. The first connector includes an inner housing that accommodates terminals connectable with terminals of the second connector inside. An outer housing is assembled with the inner housing in such a manner as to be relatively slidable in a connecting direction of the connector assembly. The second connector includes a fitting portion for receiving the inner housing.

The outer peripheral surface of the inner housing and the inner peripheral surface of the fitting portion have inclined surfaces that contact each other, and a coil spring is provided between the inner and outer housings. The resilient reaction force of the coil spring biases the inner housing forward with respect to the connecting direction when the two connectors reach a properly connected state and the inclined surfaces on the inner housing and the fitting portion are held in contact with each other to prevent backlash between the connectors in the connecting direction.

The prevention of backlash between the connectors, as described above, prevents abrasion of contact parts of the terminals and prevents a reduced electrical connection reliability of the terminals. Connection reliability of the terminals is of great importance, and therefore there is a demand for more reliably preventing abrasion of the contact parts of the terminals even if the connector device is installed in a place subject to high vibration.

The present invention was developed in view of the above situation and an object thereof is to improve overall operability of a connection operation.

SUMMARY OF THE INVENTION

The invention relates to a fluidtight connector comprising an inner housing that can fit into a receptacle of a mating connector. The inner housing accommodates at least one terminal connectable with at least one mating terminal. An outer housing is assembled with the inner housing and is relatively slidable in a connecting direction with the mating connector. At least one flange projects out from the outer surface of the inner housing and at least one pass-through opening penetrates the flange in the connecting direction with the mating connector. At least one facing wall is formed on the outer housing at a position behind the flange with respect to the connecting direction with the mating connector and is arranged to substantially face the flange. A resilient member is mounted on the inner housing and includes at least one seal. At least one leg is integral or unitary to the seal and is shaped for insertion backward through the respective pass-through openings with respect to the connecting direction. At least one backlash preventing portion is integral or unitary to the leg at a position between the flange and the facing wall and is shaped to engage peripheral edges of the respective pass-through openings.

The seal of the resilient member closely contacts the receptacle and the outer surface of the inner housing to provide sealing therebetween when the fluidtight connector is connected properly with the mating connector. Additionally, the backlash preventing portions are compressed resiliently between the flange and the facing wall and the resilient forces of the backlash preventing portions press the inner housing forward with respect to the connecting direction with the mating connector to prevent backlash in forward and backward directions. One resilient member includes the seal for sealing between the connectors and the backlash preventing portions for preventing backlash between the connectors. In this way, the number of parts is reduced as compared with the case where these are separate parts.

The seal preferably is a tube that fits on the outer surface of the inner housing before the flange with respect to the connecting direction.

The flange may extend around substantially the entire periphery of the inner housing, and the pass-through openings may be formed at positions spread around the entire periphery of the inner housing. Thus, backlash is prevented at positions spread over the periphery of the inner housing.

A rear edge portion of each backlash preventing portion with respect to the connecting direction with the mating connector may be formed with a rear inclined surface that is inclined to reduce a projecting distance from the leg towards the back with respect to the connecting direction. The rear inclined surfaces enable the resilient member to be inserted relatively smoothly without the backlash preventing portions getting caught by the front edges of the pass-through openings.

A front edge of each backlash preventing portion with respect to the connecting direction with the mating connector may be formed with a front inclined surface that is inclined to reduce a projecting distance from the leg towards the front with respect to the connecting direction. The front inclined surfaces enable the resilient member to be withdrawn relatively smoothly without the backlash preventing portions getting caught by the rear edges of the pass-through openings.

At least one guiding surface may be formed at the front peripheral edge of each pass-through opening with respect to the connecting direction with the mating connector and is inclined to increase the width of the pass-through opening towards the front with respect to the connecting direction. The inclined guiding surfaces guide the backlash preventing portions into the pass-through openings for mounting the resilient member easily.

The flange may be formed with at least one annular groove for receiving at least one annular rib formed at the opening edge of the receptacle. At least one projection may be provided in the annular groove to be pressed in an inward or outward direction by the annular rib.

The outer housing may include at least one lock mechanism engageable with the mating connector substantially in the connecting direction with the mating connector.

The invention also relates to a connector assembly with first and second connectors that are connectable with each other. The first connector includes a receptacle that is open in a connecting direction with the second connector. At least one first terminal projects in the connecting direction from the back surface of the receptacle. The second connector includes an inner housing configured to fit into the receptacle. An outer housing is assembled with the inner housing for relative displacement substantially in the connecting direction. At least one resilient member is mounted between the inner and outer housings and is compressed resiliently in the connecting direction between the inner and outer housings when the two connectors are connected properly. Fitting portions are provided at the first terminal and at the inner housing and are engageable with each other substantially in the connecting direction when the two connectors are connected properly. At least one of the fitting portions has at least one slanted surface inclined with respect to the connecting direction at a part to be held in contact with the mating fitting portion when the fitting portions are engaged with each other.

The inner housing preferably is formed with at least one cavity for at accommodating at least one second terminal connectable with the first terminal. At least one terminal insertion opening is formed at the front of the cavity with respect to the connecting direction for receiving the first terminal. The fitting portions are provided at a base end part of the one terminal on the back surface of the receptacle and at a part of the inner housing where the terminal insertion opening is formed.

The fitting portions are engaged and a resilient restoring force of the resilient member presses the inner housing in the connecting direction when the two connectors are connected properly. In this way, the slanted surface on at least one of the fitting portions is held in contact with the mating fitting portion to prevent backlash between the fitting portions. The fitting portions are formed at the base end of the first terminal and at the part where the terminal insertion opening is formed, and backlash is prevented near contact parts of both terminals. Therefore abrasion of the terminals can be prevented reliably and the connection reliability of the terminals is improved even if the connector assembly is placed in an environment subject to vibration.

The fitting portions preferably are a projection and a recess that are engageable with each other in the connecting direction when the two connectors are connected properly.

Plural first terminals and plural terminal insertion opening may be provided at corresponding positions, and the fitting portions may be provided in a one-to-one correspondence with the first terminals and the terminal insertion openings. Hence, backlash is prevented near the contact parts of the respective terminals and abrasion of the contact parts is prevented reliably.

Both fitting portions may be formed with slanted surfaces, and both slanted surfaces may have substantially the same gradient. Thus, both slanted surfaces achieve surface contact for securely preventing backlash.

The slanted surface may be substantially ring-shaped around the first terminal and/or the terminal insertion opening. Thus, even if the fitting portions are displaced in a circumferential or rotating direction with respect to a projecting direction of the terminal, the slanted surfaces are held in contact.

The minimum diameter of the slanted surface of the projection-side fitting portion may be larger than that of the slanted surface of the recess-side fitting portion. Thus, the slanted surface of the projection-side fitting portion contacts the slanted surface of the recess-side fitting portion over the entire surface without being displaced back from the slanted surface of the recess-side fitting portion even if the slanted surfaces are pressed against each other by the resilient restoring force of the resilient member.

One or more backlash preventing portions preferably are provided between adjacent fitting portions and engage each other when the connectors are connected properly for preventing backlash in a direction intersecting a juxtaposing direction of the fitting portions. Thus, the backlash preventing portions and the fitting portions prevent backlash at positions near the contact parts of both terminals for reliably preventing abrasion of the terminals.

At least one backlash preventing rib may be provided at the inner housing, and preferably near the front of the inner housing, for contacting the receptacle when the connectors are connected properly. The backlash preventing rib prevents backlash between the front end of the inner housing and the receptacle for reliably preventing abrasion of the terminals.

At least one jaw projects from the inner housing at an angle to the connecting direction and substantially faces the opening end of the receptacle. The jaw preferably is at or near the rear side of the inner housing with respect to the connecting direction. Annular backlash preventing portions may be provided at the jaw and/or the opening end of the receptacle for engaging each other when the two connectors are connected properly for preventing backlash. The annular backlash preventing portions prevent backlash between the jaw of the inner housing and the opening end of the receptacle, and hence reliably prevent abrasion of the terminals.

At least one seal ring may be mounted to the outer surface of the inner housing before the jaw and may be pressed between the inner housing and the receptacle for sealing between the inner housing and the receptacle. Backlash preventing projections may be provided on contact surfaces of the annular backlash preventing portions at an outer circumferential side. Thus, the receptacle is pressed outwardly by the seal ring and the annular backlash preventing portion is fixed by biting in the backlash preventing projections.

The outer housing may be fittable on the receptacle, and at least one outer backlash preventing portion may be provided between the outer housing and the receptacle for preventing backlash between the outer housing and the receptacle.

The resilient member may be made of rubber.

Accordingly, the connector assembly has a high connection reliability of terminals even if placed in an environment subject to vibration.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
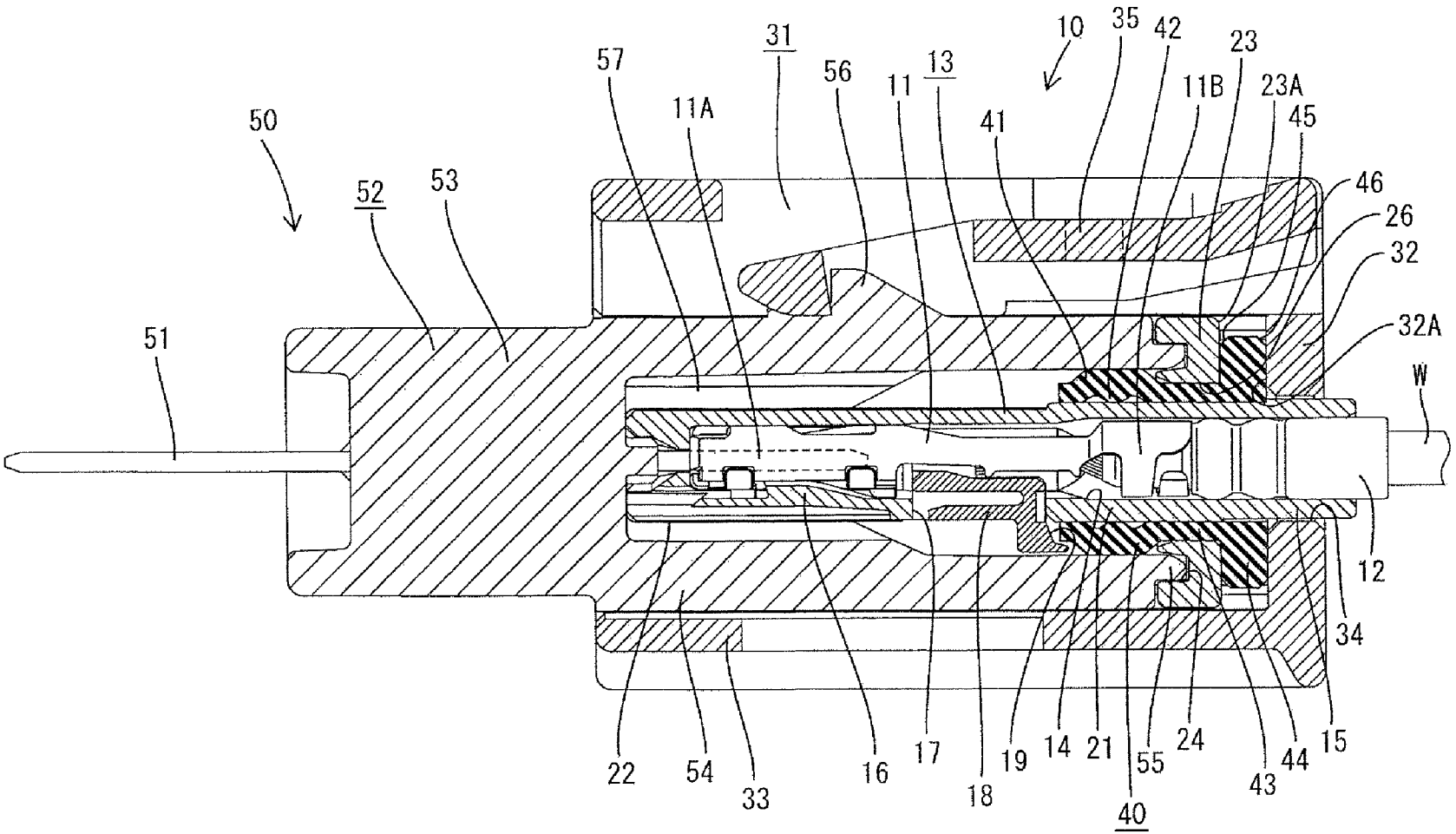
FIG. 1 is a longitudinal cross section showing properly connected female and male connectors according to the invention.
Figure 2:
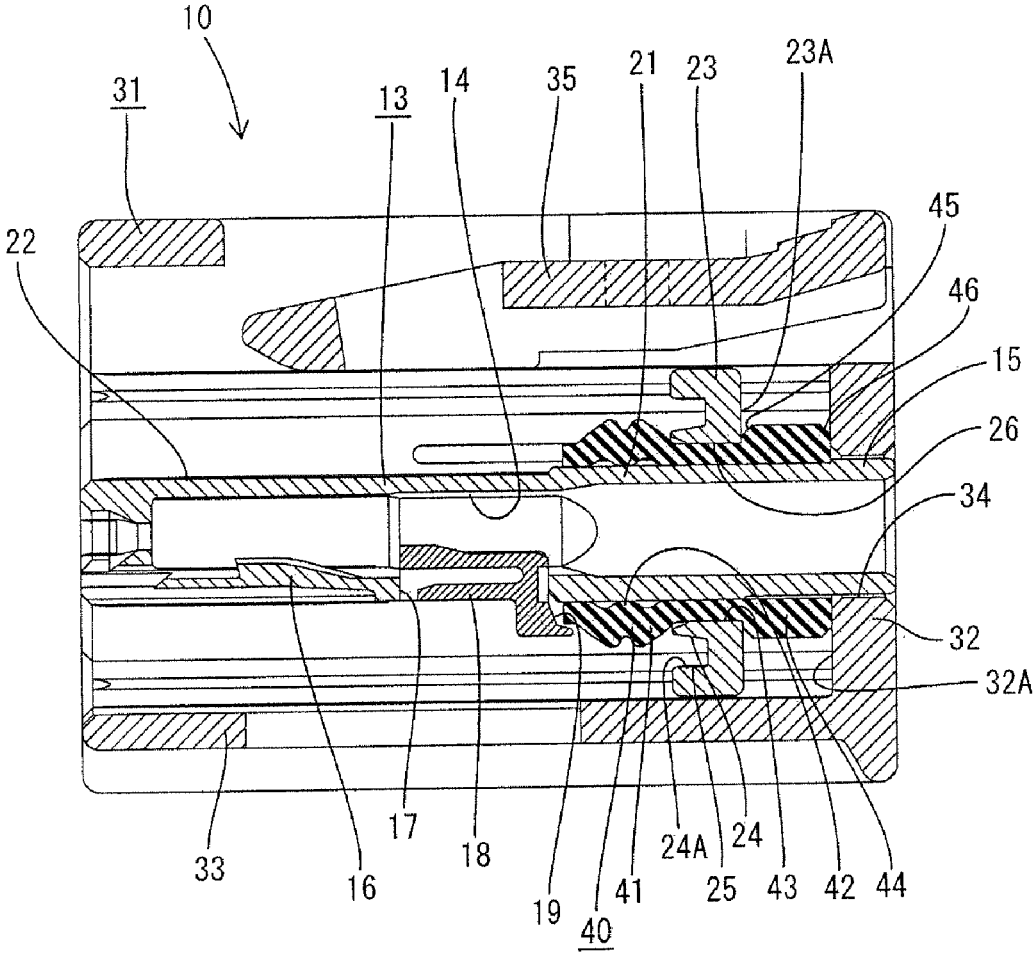
FIG. 2 is a side view in section of the female connector.
Figure 3:
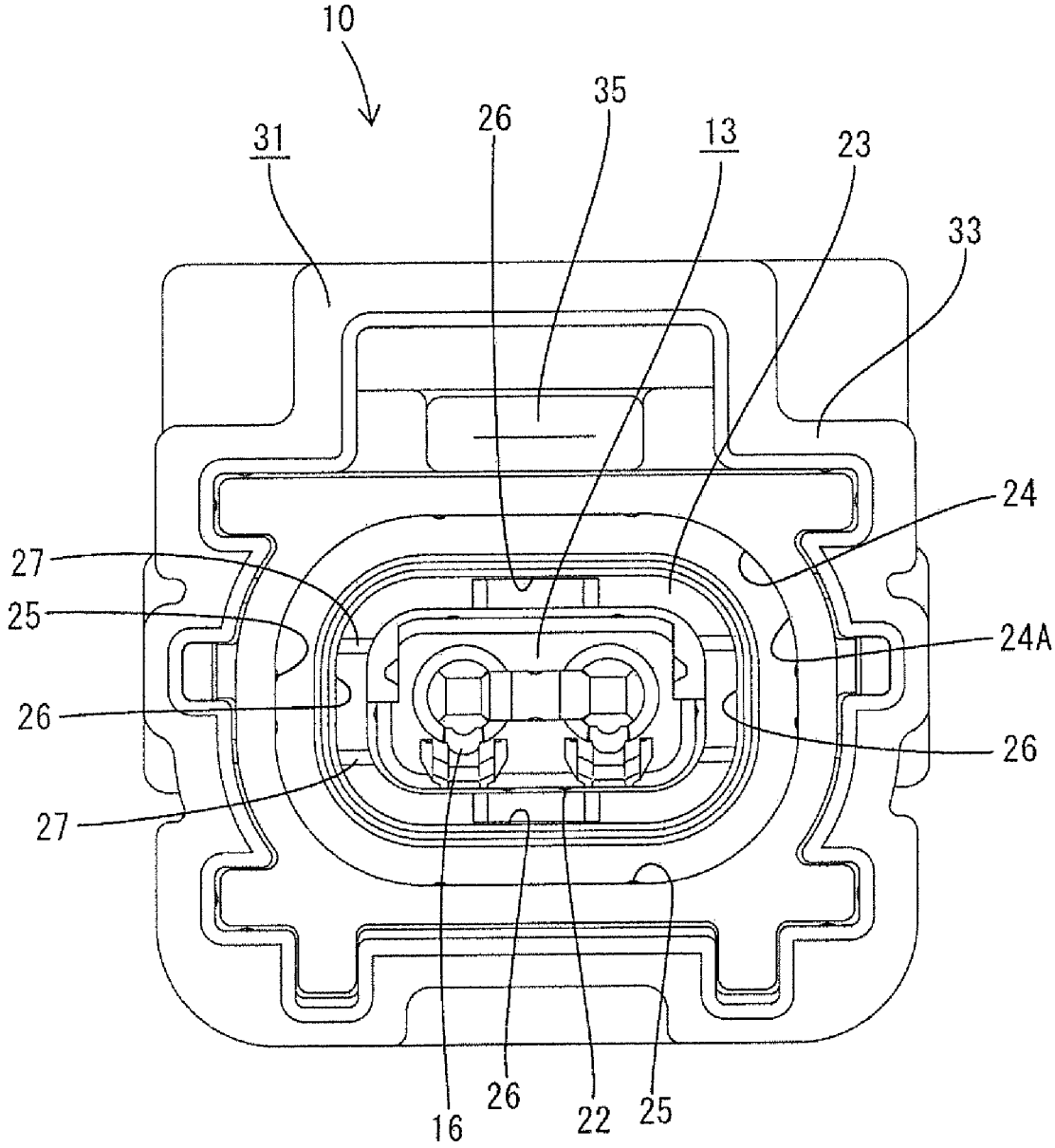
FIG. 3 is a front view of the female connector.
Figure 4:
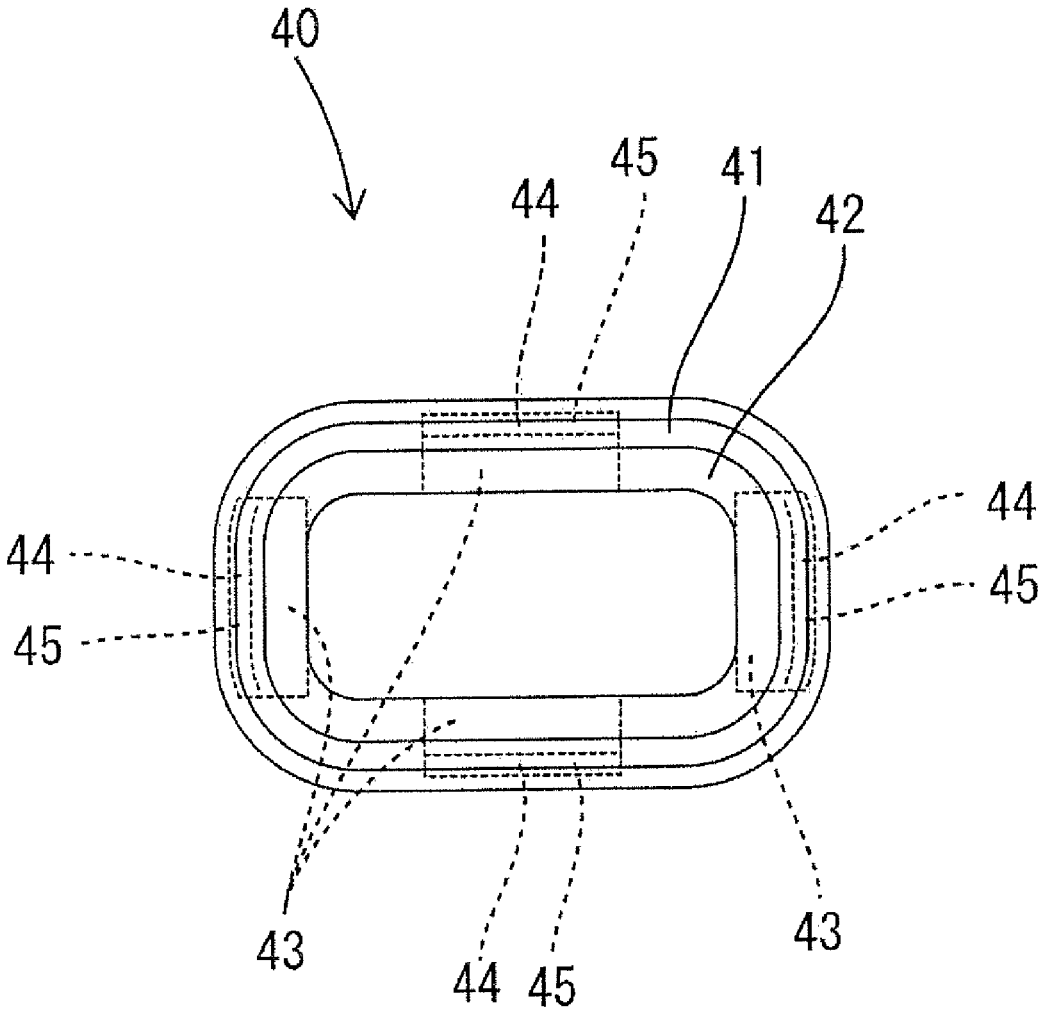
FIG. 4 is a front view of a resilient member.

A watertight connector according to a first embodiment of the invention is illustrated in FIGS. 1 to 6 and includes a female connector 10 that is connectable with a male connector 50. In the following description, ends of the connectors to be connected are referred to as the front ends and reference is made to FIG. 1 concerning the vertical direction.

The male connector 50 has male terminals 51 that are long in forward and backward directions and a male housing 52 for holding the male terminals 51. The male housing 52 is made e.g. of synthetic resin and includes a terminal holding portion 53 for holding the male terminals 51. A forwardly open substantially tubular receptacle 54 projects forward from the periphery the terminal holding portion 53 and is slightly wider than long. The male terminals 51 extend through the terminal holding portion 53 in forward and backward directions and project into the receptacle. A substantially ring-shaped annular rib 55 projects forward from the open front end of the receptacle 54 and a lock 56 projects from the top surface of the receptacle 54.

Protrusions 57 are provided near the back of the inner peripheral surface of the receptacle 54. The protrusions 57 are provided two positions on each of the upper and lower sides of the inner peripheral surface of the receptacle 54 and one position on each of the opposite sides.

The female connector 10 has female terminals 11 that are connectable with the respective male terminals 51. Each female terminal 11 is long in forward and backward directions. A substantially box-shaped connecting portion 11A is at the front end of the female terminal 11 and a barrel 11B is at the rear end of the female terminal 11. The box-shaped connecting portion 11A is connectable with the male terminal 51 and the barrel 11B is configured to be crimped, bent or folded into connection with an end of a wire W and a wire resilient plug 12. The wire resilient plug 12 is held in close contact with the inner circumferential surface of a cavity 14.

The female connector 10 includes an inner housing 13 capable of accommodating the female terminals 11 and fittable into the receptacle 54 of the male connector 50. The inner housing 13 is made e.g. of synthetic resin and is in the form of a block that is long in forward and backward directions.

Cavities 14 are formed side by side in the inner housing 13 and are configured to accommodate the female terminals 11 inserted from behind. A locking lance 16 is cantilevered substantially forward from the bottom wall of each cavity 14. A terminal insertion portion 15 is defined at a rear end of the inner housing 13 and communicates with the respective cavities 14 and includes cylindrical parts arranged substantially side by side.

Backlash preventing ribs 22 project unitarily out from the outer peripheral surface of a front part of the inner housing 13. The backlash preventing ribs 22 are formed at six positions corresponding to the protrusions 57 of the male housing 52.

A retainer mounting portion 17 is provided at a position of the inner housing 13 slightly behind a center of the inner housing 13 in forward and backward directions. The retainer mounting portion 17 communicates with the cavities 14 and opens in the bottom wall of the inner housing 13.

A side type retainer 18 made e.g. of synthetic resin is mounted into the retainer mounting portion 17 and 18 engages the connecting portions 11A of the female terminals 11 from behind to retain the female terminals 11 when the retainer 18 is mounted at a full locking position. A rearwardly open accommodating recess 19 is formed in a part of the rear end of the retainer 18 from the bottom edge to the substantially opposite lateral edges and is spaced outward from the outer peripheral surface of the inner housing 13.

A fitting portion 21 is defined on a part of the outer peripheral surface of the inner housing 13 adjacent to and behind the retainer mounting portion 17 and a sealing portion 41 of a resilient member 40 is fit on the fitting portion 21, as described later. The fitting portion 21 has a slightly wide substantially rectangular cross-section in a direction substantially orthogonal to forward and backward directions and the outer peripheral surface of the fitting portion 21 has flat even surfaces with four arcuate corner portions.

A flange 23 projects out from the inner housing 13 in directions substantially orthogonal to the connecting direction of the two connectors 10, 50. The flange 23 extends around substantially the entire periphery of the inner housing 13 at a position before the terminal inserting portion 15 and behind the fitting portion 21.

An annular groove 24 is formed in the front surface of the flange 23 for receiving the annular rib 55. The annular groove 24 has a slightly wide ring shape and surrounds the entire periphery of the inner housing 13 (see FIG. 3). Projections 25 are provided on an outer peripheral surface 24A of the annular groove 24 and engage the annular rib 55. The projections 25 are arranged preferably at two substantially facing positions on each of the upper, lower, left and right sides of the annular groove 24. Thus, the projections 25 are arranged at positions spread over the entire periphery of the inner housing 13.

The rear pressing surface 23A faces rearwardly on the flange 23 and defines a flat even surface aligned substantially perpendicular to the outer peripheral surface of the inner housing 13.

Pass-through openings 26 are formed at the base of the flange 23 and substantially continuous with the inner housing 13. The pass-through openings 26 are formed at a total of four positions on the flange 23 disposed respectively above, below, to the left and to the right of the inner housing 13, and hence at positions spread over the entire periphery of the inner housing 13 (see FIG. 3). The pass-through openings 26 arranged above and below the inner housing 13 are located in the widthwise center of the inner housing 13, and the pass-through openings 26 arranged to the left and right are located substantially at the center of the inner housing 13 in the height direction.

Each pass-through opening 26 has a substantially rectangular cross-sectional shape longer in the peripheral direction of the inner housing 13 and penetrates the flange 23 in forward and backward directions. The inner peripheral surface of each pass-through opening 26 is substantially flush with the outer peripheral surface of the inner housing 13.

Guiding surfaces 27 are formed at the front opening edge of each pass-through opening 26. The guiding surfaces 27 are formed at the opposite longitudinal ends of each pass-through opening 26 and are inclined to gradually increase the opening width of the pass-through opening 26 in its longitudinal direction towards the front.

The female connector 10 has an outer housing 31 that surrounds the inner housing 13. The outer housing 31 is separate from the inner housing 13 and is assembled with the inner housing 13 to be relatively slidable in forward and backward directions.

The outer housing 31 is made e.g. of synthetic resin and includes a facing wall 32. The facing wall 32 has an outer shape slightly larger than the flange 23 and face the flange 23 from behind. The outer housing 31 also has an outer tube 33 that projects forward from the peripheral edge of the facing wall 32. A space is defined between the outer tube 33 and the inner housing 13 for receiving the receptacle 54 of the male connector 50.

A loose insertion hole 34 penetrates the facing wall 32 and the terminal inserting portion 15 of the inner housing 13 is loosely insertable therein. A flat second pressing surface 32A is defined at the front of the facing wall 32. The second pressing surface 32A and the first pressing surface 23A of the flange 23 face one another and are substantially parallel.

The outer housing 31 includes a lock arm 35 that is engageable with the lock projection 56 of the male connector 50 to lock the two connectors 10, 50 in a properly connected state.

The resilient (rubber) member 40 is mounted on the inner housing 13 and is long in forward and backward directions. A wide tubular sealing portion 41 is defined at the front of the resilient member 40 and is fit on the fitting portion 21 of the inner housing 13. A dimension of the sealing portion 41 in forward and backward directions substantially equals that of the fitting portion 21 from the front surface of the flange 23 to a position behind the retainer mount portion 17. An intermediate part of the sealing portion 41 in forward and backward directions bulges out radially, and the front and rear ends thereof are thinned. The front thinned part of the sealing portion 41 is accommodated in the accommodating recess 19 of the retainer 18 mounted at the full locking position to prevent the resilient member 40 from coming out forward. A lip 42 is formed at a middle position of the inner peripheral surface of the sealing portion 41 in forward and backward directions to improve waterproof sealing. The inner peripheral surface of the sealing portion 41 near the front and rear ends and the lip 42 closely contacts the outer peripheral surface of the fitting portion 21 when the resilient member 40 is mounted on the inner housing 13, and the outward bulge projects before the annular groove 24.

Four legs 43 extend unitarily back from upper, lower, left and right positions on the rear of the sealing portion 41 corresponding to the pass-through openings 26. The legs 43 are shaped to be inserted backward through the pass-through openings 26 (see FIG. 4).

Figure 5:
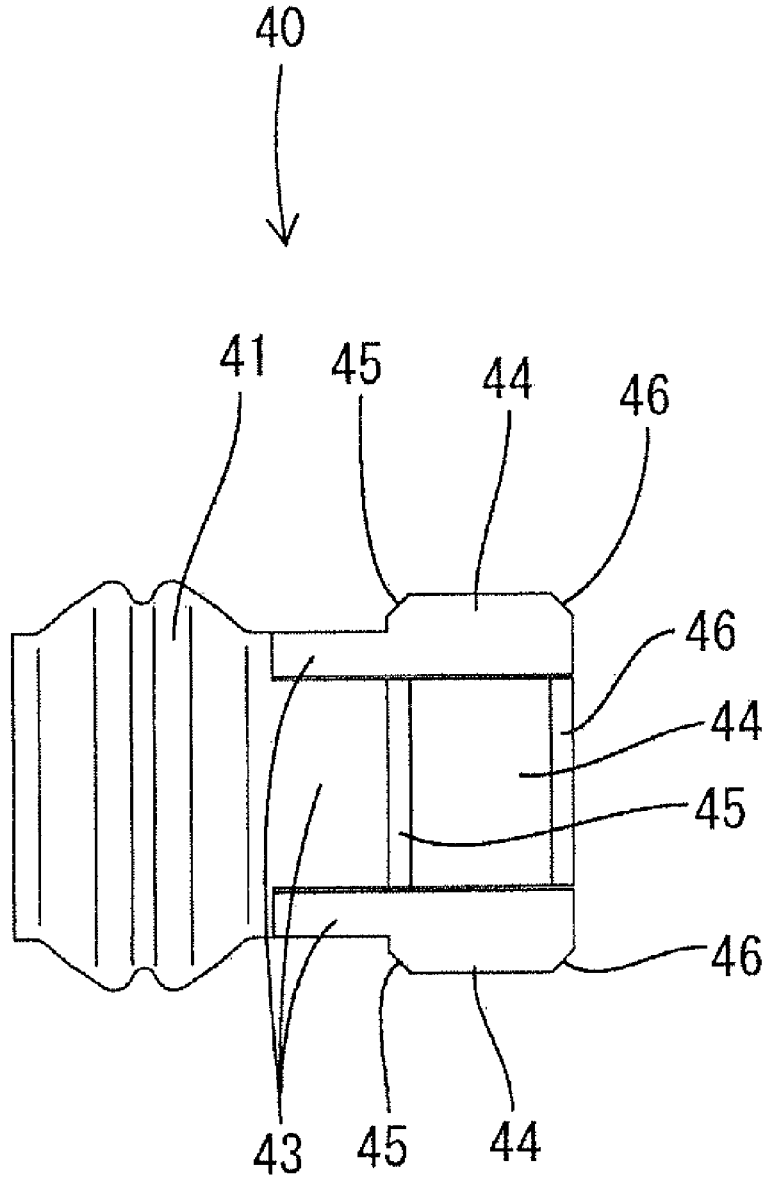
FIG. 5 is a side view of the resilient member.
Figure 6:
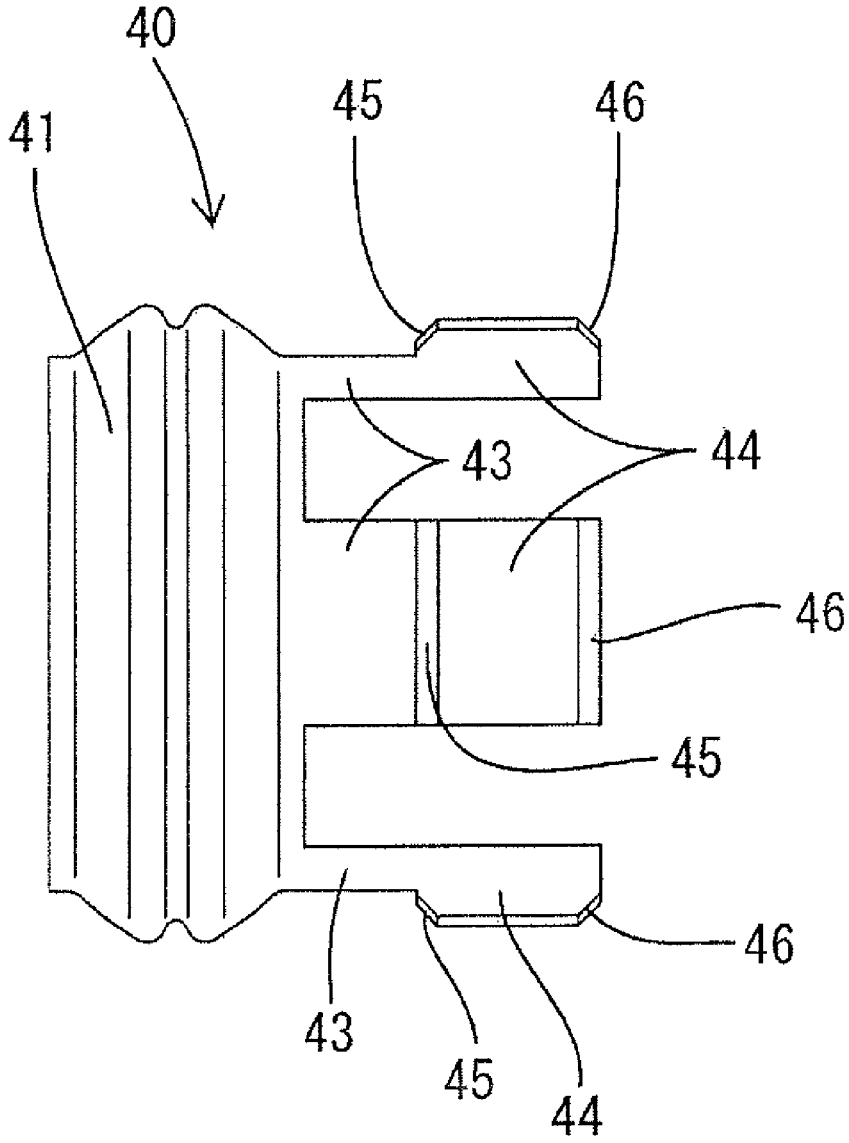
FIG. 6 is a plan view of the resilient member.

Each leg 43 is substantially a rectangle that is long in forward and backward directions when seen in inward and outward directions and has a width in a direction perpendicular to forward and backward directions that is substantially equal to or slightly wider than the width of the pass-through opening 26 (see FIGS. 5 and 6). Additionally, each leg 43 is substantially plate-like and has a thickness in inward and outward directions that is substantially equal to the thickness of the thinned front and rear ends of the sealing portion 41. The inner surface of each leg 43 is substantially flush with the inner peripheral surface of the sealing portion 41.

A backlash preventing portion 44 projects unitarily out from a rear part of each leg 43. Each backlash preventing portion 44 is formed over substantially the entire width of the leg 43 and has a substantially rectangular shape that is slightly longer in the width direction when viewed in inward and outward directions. The backlash preventing portion 44 projects from the outer surface of the leg portion 43 by a distance substantially equal to the thickness of the leg 43 in inward and outward directions. Thus the sum of the thicknesses of the backlash preventing portion 44 and the leg 43 in inward and outward directions is about twice the dimension of the opening of the pass-through opening 26 in inward and outward directions. The backlash preventing portions 44 engage peripheral edges of the pass-through openings 26 from behind when the rear portions of the legs 43 are inserted into the pass-through openings 26. The projecting end surfaces of the backlash preventing portions 44 are slightly inwardly of the outermost surface of the bulge of the sealing portion 41.

Front and rear inclined surfaces 45 and 46 are formed at front and rear edges of each backlash preventing portion 44 and are inclined to reduce a projecting distance. The front and rear inclined surfaces 45, 46 are formed over substantially the entire width of each backlash preventing portion 44. All of the legs 43 and the backlash preventing portions 44 are shaped substantially identically.

The resilient member 40 is mounted on the inner housing 13 from the front before the retainer 18 is mounted. Specifically, the resilient member 40 is oriented to locate the sealing portion 41 at the front and the backlash preventing portions 44 at the rear, and is mounted on the front part of the inner housing 13 so that the four legs 43 extend substantially along the outer peripheral surface of the inner housing 13. Thus, the front end of the inner housing 13 is located at the inner sides of the four legs 43. The resilient member 40 then is moved back so that the inner peripheral surfaces of the respective legs 43 and the sealing portion 41 are moved backward along the outer peripheral surface of the inner housing 13 and the rear inclined surfaces 46 of the respective backlash preventing portions 44 contact the front end edges of the pass-through openings 26. Further, the opposite widthwise ends of the respective backlash preventing portions 44 contact the guiding surfaces 27 of the pass-through openings 26.

The resilient member 40 is pushed back in this state so that the front edges of the pass-through openings 26 gradually squeeze the rear inclined surfaces 46 of the backlash preventing portions 44 inwardly. Further, the guiding surfaces 27 gradually press the opposite widthwise sides of the backlash preventing portions 44 inwardly in the width direction and gradually decrease the widths of the backlash preventing portions 44. The backlash preventing portions 44 are compressed sufficiently to be accommodated in the pass-through openings 26. The backlash preventing portions 44 resiliently restore upon reaching positions behind the pass-through openings 26 and engage the peripheral edges of the pass-through openings 26 from behind.

The inclinations of the rear inclined surfaces 46 and the guiding surfaces 27 of the pass-through openings 26 ensure that the backlash preventing portions 44 are inserted smoothly and are compressed gradually without getting caught by the front edges of the pass-through openings 26. Thus, the resilient member 40 can be mounted easily.

The resilient member 40 is pulled forward to be detached from the inner housing 13. As a result, the rear edges of the pass-through openings 26 contact and the front inclined surfaces 45 of the backlash preventing portions 44 and gradually squeeze the backlash preventing portions 44 inwardly. Thus the backlash preventing portions 44 are pulled out smoothly without getting caught by the rear edges of the pass-through openings 26. The front inclined surfaces 45 ensure that the resilient member 40 can be detached easily.

The two connectors 10, 50 are positioned facing each other and are brought closer so that the front end of the inner housing 13 is inserted partly inserted into the receptacle 54 and the receptacle 54 is inserted between the inner housing 13 and the outer tube 33 of the outer housing 31. The projecting ends of the protrusions 57 of the receptacle 54 contact and press the backlash preventing ribs 22 of the inner housing 13, and the male terminals 51 enter into the connecting portions 11A of the respective female terminals 11.

The two connectors 10, 50 are pushed farther towards one another so that the leading end of the receptacle 54 reaches a position outside the sealing portion 41 of the resilient member 40 and moves further back while squeezing the bulge of the sealing portion 41 inwardly. The annular rib 55 of the receptacle 54 is inserted into the annular groove 24 of the flange 23 while being pressed out by the resilient restoring force of the sealing portion 41, and is accommodated in the annular groove 24 while pressing the projections 25.

The leading end of the receptacle 54 presses the flange 23 back when the connectors 10, 50 are pushed further in approaching directions. Additionally, the backlash preventing portions 44 arranged between the flange 23 and the facing wall 32 are compressed resiliently between the first and second pressing surfaces 23A, 32A.

The leading end of the lock arm 35 moves over the lock projection 56 and resiliently restores when the two connectors 10, 50 are connected properly. Thus, the lock arm 35 and the lock projection 56 are engaged in forward and backward directions to lock the connectors 10, 50 in their properly connected state (see FIG. 1). Further, the sealing portion 41 of the resilient member 40 is held in close sealing contact with the inner surface of the receptacle 54 and the outer surface of the inner housing 13. The backlash preventing portions 44 and the rear portions of the legs 43 are compressed resiliently between the flange 23 and the facing wall 32, and the first pressing surface 23A of the flange 23 of the inner housing is pressed forward towards the terminal holding portion 53 by their resilient forces. Further, the second pressing surface 32A of the facing wall 32 of the outer housing 31 is pressed backward in an engaging direction of the lock arm 35 with the lock projection 56 by the resilient forces of the backlash preventing portions 44 to prevent backlash in forward and backward directions at these lock parts.

In this way, one resilient member 40 provides sealing and prevents backlash between the two connectors 10, 50. Accordingly, the number of parts is reduced as compared with the case where a sealing member for sealing between the two connectors 10, 50 and a backlash preventing member for preventing backlash have to be provided as separate parts.

The backlash preventing portions 44 expand along the first and second pressing surfaces 23A, 32A upon being pressed between the inner and outer housings 13 and 31. Thus, contact pressures on the flange 23 and the facing wall 32 are distributed to become smaller as compared to a case where a metallic spring is used. Therefore, there is no need for an anti-creep measure.

The pass-through openings 26 in the flange 23 are sufficient for mounting the resilient member 40 on the inner housing 13. Thus, the inner and outer housings 13 and 31 can be simplified as compared with the case where inner and outer housings are formed with spring accommodating holes for accommodating the front and rear ends of a metallic spring.

The pass-through openings 26 are at positions spread over the substantially entire periphery of the inner housing 13, and the backlash preventing portions 44 are at the positions corresponding to the pass-through openings 26. Thus, backlash between the two connectors 10, 50 in forward and backward directions can be prevented at positions spread over substantially the entire periphery of the inner housing 13. All of the backlash preventing portions 44 and all of the legs 43 have substantially identical shapes and rigidities. Hence, substantially equal resilient forces act at four positions spread over the entire periphery of the inner housing 13, and backlash can be prevented in an unbiased manner.

The resilient force of the sealing portion 41 presses the annular rib 55 against the outer peripheral surface of the annular groove 24 to bite in the projections 25. Thus, the annular rib 55 and the annular groove 24 are held firmly fixed over the substantially entire periphery.

The backlash preventing ribs 22 closely contact the protrusions 57 of the receptacle 54 at the front end of the inner housing 13 to prevent backlash between the inner housing 13 and the receptacle 54. Thus, backlash between the male housing 52 and the inner housing 13 is prevented at both front and rear ends of the inner housing 13 to prevent abrasion of the terminals 11, 51 even if the two connectors 10, 50 are subjected to strong vibration.

As described above, the sealing portion 41 of the resilient member 40 closely contacts the inner peripheral surface of the receptacle 54 and the outer peripheral surface of the inner housing 13 to provide sealing when the female connector 10 is connected properly with the male connector 50. Further, the backlash preventing portions 44 are compressed between the flange 23 and the facing wall 32. Thus, the resilient forces of the backlash preventing portions 44 press the inner housing 13 forward to prevent the backlash of the inner housing 13 in forward and backward directions. One resilient member 40 includes the sealing portion 41 for sealing between the two connectors 10, 50 and the backlash preventing portions 44 for preventing backlash between the two connectors 10, 50. In this way, the number of parts can be reduced as compared with the case where these are separate parts. Therefore, the number of parts can be reduced while ensuring sealing between the two connectors 10, 50 and preventing backlash between the two connectors 10, 50.

Figure 7:
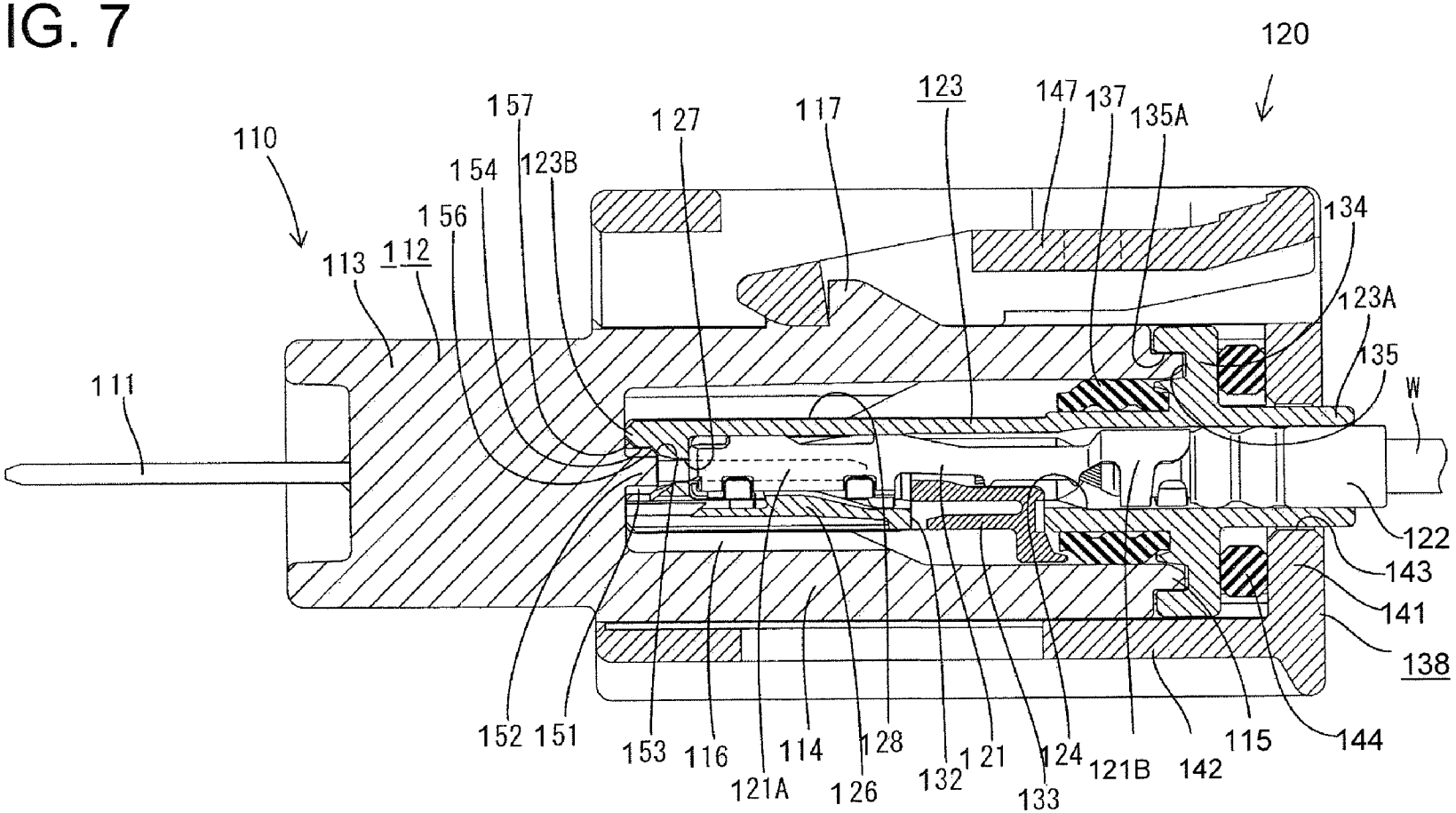
FIG. 7 is a side view in section showing a properly connected state of a connector assembly according to a second embodiment.
Figure 8:
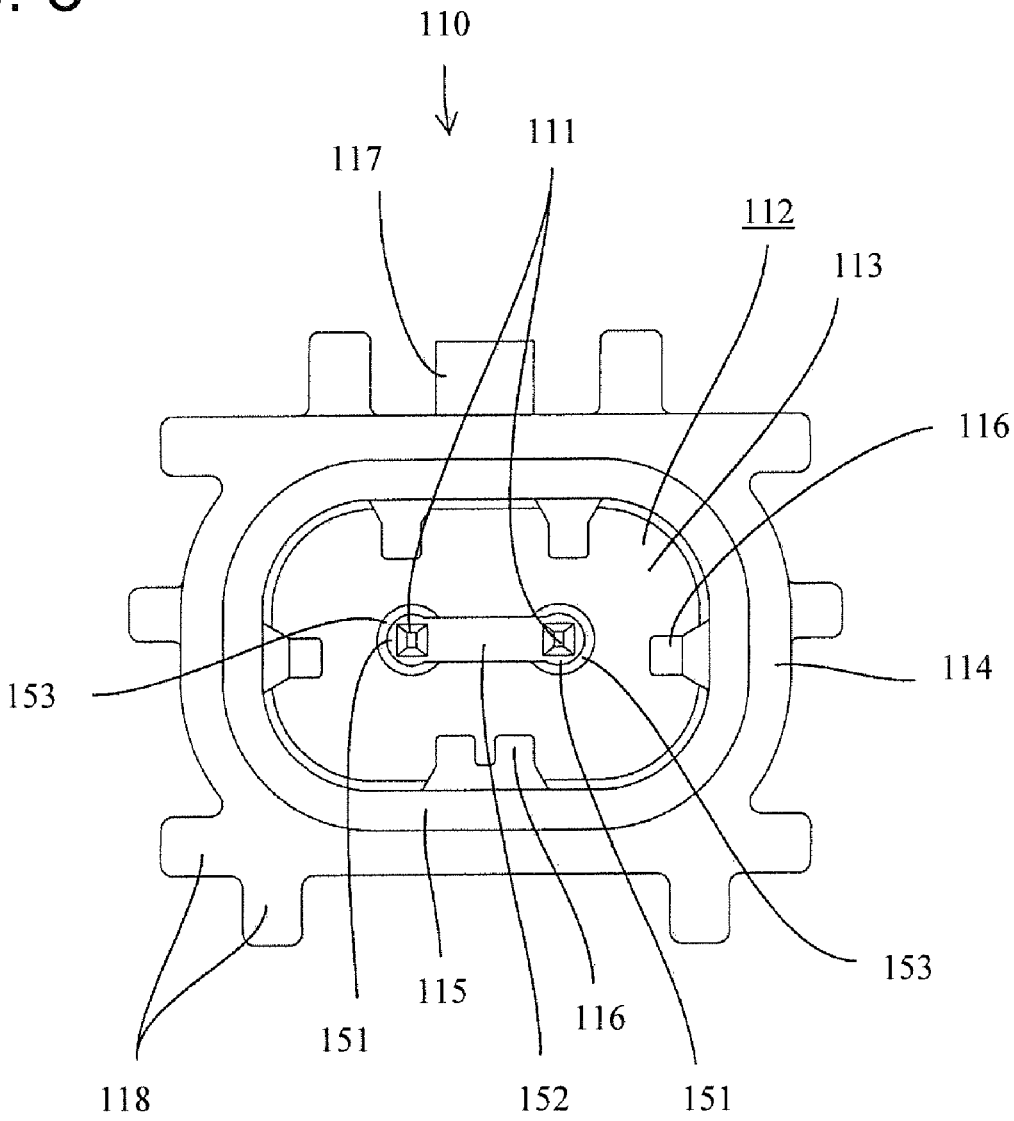
FIG. 8 is a front view of a male connector.
Figure 9:
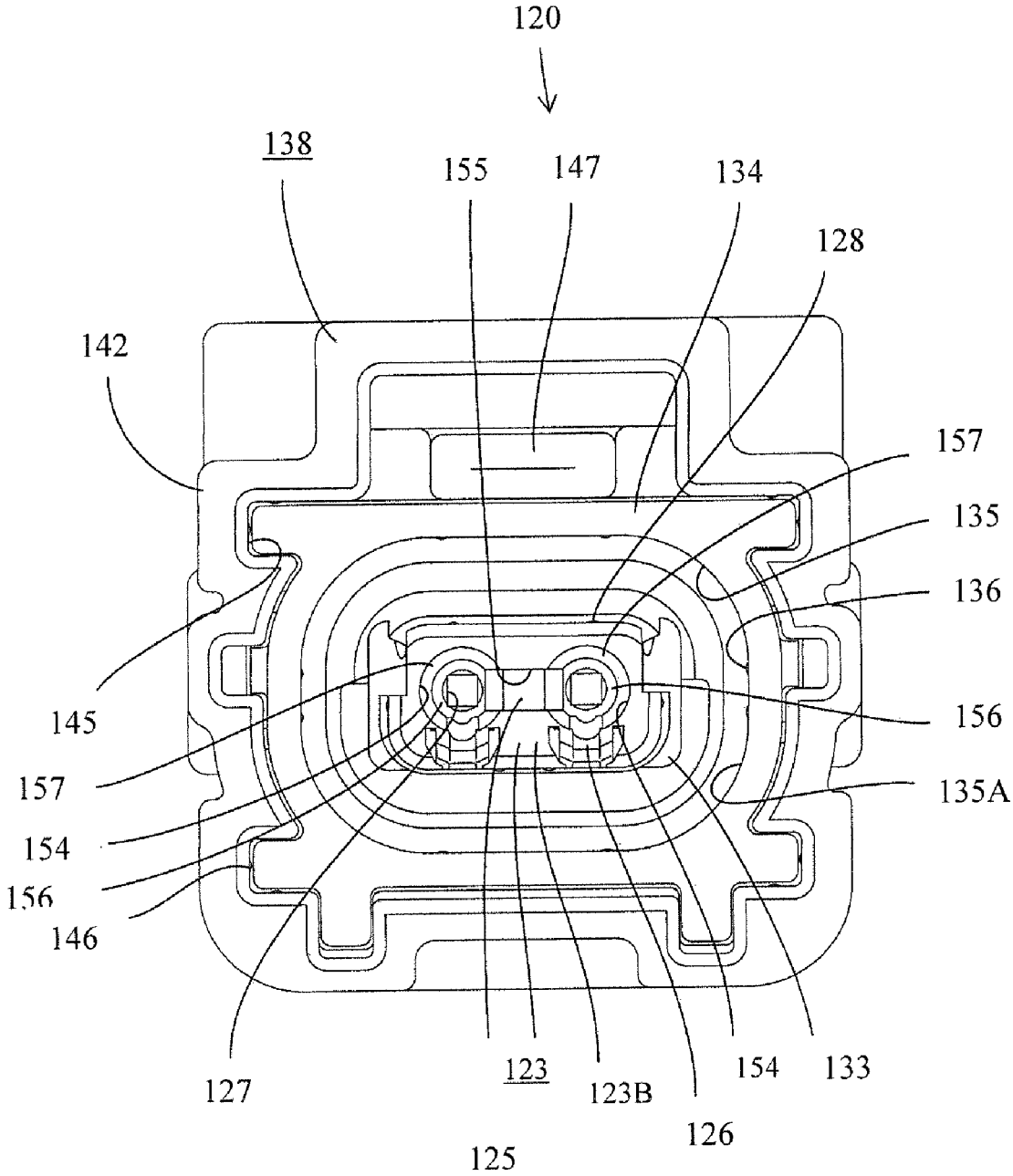
FIG. 9 is a front view of a female connector.

A connector assembly according to a second embodiment of the invention includes a male connector 110 and a female connector 120 that are connectable with each other as shown in FIGS. 7 to 9. In the following description, ends of the connectors 110, 120 to be connected are referred to as front ends and reference is made to FIG. 7 concerning vertical direction.

The male connector 110 has two male terminals 111 and a male housing 112 for holding the male terminals 111. The male housing 112 is made e.g. of synthetic resin and includes a terminal holding portion 113 for holding the male terminals 111 in forward and backward directions. A receptacle 114 projects forward in a connecting direction with the other connector from the periphery of the terminal holding portion 113. The terminal holding portion 113 has a wide rectangular shape (see FIG. 8) when viewed from the front.

The receptacle 114 is a forwardly open tube, and a ring-shaped annular rib 115 projects forward at opening front end of the receptacle 114.

Protrusions 116 are provided at the rear end with respect to the connecting direction of the inner peripheral surface of the receptacle 114. The protrusions 116 are provided at six positions, i.e. two positions on each of the upper and lower sides of the inner peripheral surface of the receptacle 114 and at least one position on each of the opposite sides.

A lock 117 projects from the top surface of the receptacle 114. Further, guide ribs 118 extend in forward and backward directions on the outer peripheral surface of the receptacle 114. The guide ribs 118 are provided at a total of ten positions, particularly one pair at the opposite sides of the lock projection 117 on the top surface of the receptacle 114, one at each of upper, lower and middle positions of each side surface, and one pair at the widthwise ends of the bottom surface.

Each male terminal 111 has a substantially square cross section and is long in forward and backward directions. Two male terminals 111 are arranged substantially side by side at intermediate position of the terminal holding portion 113 while being spaced apart by a specified distance.

The female connector 120 has two female terminals 121 connectable with the respective male terminals 111. Each female terminal 121 has a long shape in forward and backward directions and includes a substantially box-shaped connecting portion 121A that is connectable with the male terminal 111 at the front end and a barrel 121B at the rear end. An unillustrated resilient tongue is provided in the connecting portion 121A and contacts the male terminal 111 at an intermediate position of the connecting portion 121A in forward and backward directions to establish an electrical connection between the two terminals 111, 121. The barrel 121B is crimped, folded or bent into connection with an end of a wire W and a wire resilient rubber plug 122 to be held in close contact with the inner peripheral surface of a cavity 124 to provide sealing in the cavity 124.

The female connector 120 includes an inner housing 123 capable of accommodating the female terminals 121 and fittable into the receptacle 114 of the male connector 110. The inner housing 123 is made e.g. of synthetic resin and is substantially in the form of a wide block.

Two cavities 124 are formed substantially side by side in the inner housing 123 for accommodating the female terminals 121 inserted from behind. The cavities 124 are arranged at positions corresponding to the male terminals 111 and are partitioned by a partition wall 125. A locking lance 126 is cantilevered forward from the bottom wall of each cavity 124. A tube 123A is formed at the rear end of the inner housing 123 and communicates with the respective cavities 124 and includes substantially cylindrical tubes arranged side by side.

Terminal insertion openings 127 are formed in a front wall 123B of the inner housing 123 at positions corresponding to the respective cavities 124. The terminal insertion openings 127 penetrate the front wall 123B in forward and backward directions at spaced apart positions in conformity with the positions of the male terminals 111 and have substantially square shapes to permit insertion of the male terminal 111.

Backlash preventing ribs 128 are provided near the front end of the inner housing 123. The backlash preventing ribs 128 are project out from the outer peripheral surface of the inner housing 123 at a total of six positions corresponding to the protrusions 116 of the male housing 112 (see FIG. 9).

A retainer mounting portion 132 is provided slightly behind a center of the inner housing 123 in forward and backward directions and a side type retainer 133 is to be mounted in the retainer mounting portion 132. The retainer 133, when mounted at a full locking position in the retainer mounting portion 132, can engage the connecting portions 121A of the female terminals 121 to retain the female terminals 121.

A jaw 134 projects out substantially orthogonal to the connecting direction of the connectors 110, 120 over substantially the entire periphery ids provided at a rear position of the outer peripheral surface of the inner housing 123 before the terminal tube 123A. The jaw 134 is arranged to face the opening end of the receptacle 114, and an annular groove 135 is formed in the front surface of the jaw 134 for engaging the annular rib 115 of the receptacle 114. The annular groove 135 has a slightly wide ring shape to surround the inner housing 123 over substantially the entire periphery. Backlash preventing projections 136 are provided on an outer peripheral surface 135A of the annular groove 135 to be pressed by the annular rib 115. The backlash preventing projections 136 are arranged at two substantially facing positions on each of the upper, lower, left and right sides of the annular groove 124, i.e. preferably at a total of eight positions. Thus, the backlash preventing projections 136 are arranged at positions spread over the entire periphery of the inner housing 123.

The rear surface of the jaw 134 is substantially flat and substantially perpendicular to the outer peripheral surface of the inner housing 123.

A seal ring 137 is to be fit on the outer peripheral surface of the inner housing 123 at a position before the jaw 134. An intermediate part of the seal ring 137 in forward and backward directions bulges radially out, and is mounted on the inner housing 123 with the bulging part projecting before the annular groove 135.

The female connector 120 includes an outer housing 138 surrounding the inner housing 123. The outer housing 138 is separate from the inner housing 123 and is assembled with the inner housing 123 in a manner to be relatively slidable in forward and backward directions.

The outer housing 138 is made e.g. of synthetic resin and includes a facing wall 141 having an outer shape slightly larger than the jaw 134 and facing the jaw 134 from behind. An outer tube 142 projects forward from the peripheral edge of the facing wall 141. A space is formed between the outer tube 142 and the inner housing 123 for receiving the receptacle 114 of the male connector 110.

A loose insertion hole 143 penetrates the facing wall 141 and loosely receives the terminal tube 123A of the inner housing 123. The front surface of the facing wall 141 is a substantially flat surface facing the rear surface of the jaw 134 substantially in parallel. A resilient member 144 is mounted between this facing wall 141 and the jaw 134 of the inner housing 123. The resilient member 144 is made of a resilient material such as rubber and has a wide tubular shape to surround the terminal tube 123A.

The outer tube 142 has guide grooves 145 for receiving the respective guide ribs 118 of the receptacle 114 in forward and backward directions. Entry of the guide ribs 118 into the guide grooves 145 guides movements of the two connectors 110, 120 in forward and backward directions. Outer backlash preventing portions 146 are provided in the guide grooves 145 at upper and lower end positions of the opposite side surfaces of the outer tube 142. Two outer backlash preventing portions 146 are provided in each guide groove 145. Specifically, the outer backlash preventing portions 146 are provided on the side surface and the upper surface in each upper guide groove 145 while being provided on the side surface and the lower surface in each lower guide groove 145.

The outer tube 142 includes a lock arm 147 that is engageable with the lock 117 of the male connector 110 to lock the connectors 110, 120 in their properly connected state. The lock arm 147 is cantilevered forward in the upper wall of the outer tube 142 and has a free front end that is resiliently displaceable in directions intersecting the connecting direction.

Fitting projections 151 are provided at the back of the receptacle 114 and near the base ends of the male terminals 111. The fitting projections 151 are provided at positions corresponding to the respective male terminals 111 and define cylindrical tubes that project forward from the back surface of the receptacle 114 while individually covering the base end parts of the respective male terminals 111 over substantially over the entire circumferences. A cross-sectional shape of each fitting projection 151 in a direction substantially orthogonal to an axial line is substantially round and is uniform in forward and backward directions except at a front end portion. The axial line of each fitting projection 151 substantially coincides with that of the male terminal 111. The fitting projections 151 are unitary to the receptacle 114, and enable the male terminals 111 to follow vibrating movements of the male connector 110.

A projection-side backlash preventing portion 152 is provided between the adjacent fitting projections 151. The projection-side backlash preventing portion 152 connects the fitting projections 151 in the width direction and projects forward from the back surface of the receptacle 114 along the both fitting projections 151. The projection-side backlash preventing portion 152 has a substantially wide rectangular shape when viewed from the front. A projecting distance of the projection-side backlash preventing portion 152 substantially equals the projecting distance of the two fitting projections 151, and the front end surface thereof is substantially flush with the front end surfaces of the fitting projections 151. Upper and lower surfaces of the projection-side backlash preventing portion 152 are substantially flat and have a wide rectangular shape.

Fitting recesses 154 are formed in a part of the inner housing 123 where the terminal insertion openings 127 are formed. The fitting recesses 154 are recessed back from the front surface of the inner housing 123, and the depth thereof substantially equals the projecting distance of the fitting projections 151. The terminal insertion openings 127 extend back towards the respective cavities 124 from the back surfaces of the fitting recesses 154, and the fitting recesses 154 and the terminal insertion openings 127 communicate with each other in forward and backward directions. Each fitting recess 154 is provided at the position of each terminal insertion opening 127, and the axial line thereof substantially coincides with the axial line of the corresponding terminal insertion opening 127.

The fitting recesses 154 have a substantially round cross section so that the fitting projections 151 are insertable therein. More specifically, the cross section of the fitting recesses 154 is substantially same in forward and backward directions except at front and rear ends, and the radial dimension thereof equals that of the fitting projections 151 except the front ends.

A recess-side backlash preventing portion 155 is provided between the adjacent fitting recesses 154. The recess-side backlash preventing portion 155 is recessed back from the front surface of the inner housing 123 and communicates with the fitting recesses 154 in the width direction. The recess-side backlash preventing portion 155 has a substantially wide rectangular shape when viewed from the front, and the height thereof substantially equals the height of the projection-side backlash preventing portion 152. The depth of the recess-side backlash preventing portion 155 equals or is slightly larger than the projecting distance of the projection-side backlash preventing portion 152, and the partition wall 125 partitioning the cavities 124 is arranged at the back side of the recess-side backlash preventing portion 155. The upper and lower surfaces of the recess-side backlash preventing portion 155 both are flat surfaces having wide rectangular shapes.

A projection-side slanted surface 153 is formed along the outer edge of the front end of each fitting projection 151 except a part connected with the projection-side backlash preventing portion 152. The projection-side slanted surface 153 faces the adjacent male terminal 111 and is substantially C-shaped when viewed from the front (see FIG. 8). The projection-side slanted surface 153 is inclined to gradually reduce a radial dimension from the axial line towards the front end of the fitting projection 151. The front end surface of the fitting projection 151 is substantially circular, and the diameter thereof is slightly larger than a diagonal dimension of the cross section of the male terminal 111.

A recess-side slanted surface 156 inclined to reduce the width of an opening toward the back side is formed near the rear end portion of each fitting recess 154. The recess-side slanted surface 156 is formed in the peripheral edge of each fitting recess 154 except a part communicating with the recess-side backlash preventing portion 155, and is substantially C-shaped when viewed from front.

The projection-side slanted surfaces 153 contact the recess-side slanted surfaces 156 from the inner side when the fitting projections 151 and the fitting recesses 154 are engaged. The minimum diameter of the projection-side slanted surfaces 153 at the front end surfaces of the fitting projections 151 exceeds the minimum diameter of the recess-side slanted surfaces 156 in the openings at the rear end edges of the fitting recesses 154. The projection-side slanted surfaces 153 and the recess-side slanted surfaces 156 have substantially the same gradient. The width of the recess-side slanted surfaces 156 along the inclination exceeds the width of the projection-side slanted surfaces 153 along the inclination.

A guiding slanted surface 157 is formed at the front edge of each fitting recess 154 and is inclined to increase the width of the opening towards the front. The guiding slanted surface 157 is formed in the peripheral edge of each fitting recess 154 except a part communicating with the recess-side backlash preventing portion 155 and is substantially C-shaped when viewed from the front, similar to the recess-side slanted surfaces 156.

The two connectors 110, 120 are positioned facing each other and then are brought closer so that the front end of the inner housing 123 is inserted into the receptacle 114 and so that the receptacle 114 is inserted substantially between the inner housing 123 and the outer tube 142 of the outer housing 138. At this time, the guide ribs 118 of the receptacle 114 enter into the respective guide grooves 145 of the outer tube 142 and are guided while being held in sliding contact with the outer backlash preventing ribs 128 of the guide grooves 145. The backlash preventing ribs 128 contact the projecting ends of the protrusions 116 when the front end of the inner housing 123 reaches the protrusions 116 at the back of the receptacle 114. Further, the male terminals 111 are inserted into the connecting portions 121A of the female terminals 121 through the terminal insertion openings 127 of the inner housing 123.

The two connectors 110, 120 are pushed farther in approaching directions so that the leading end of the receptacle 114 reaches a position outside the seal ring 137 and moves farther back while squeezing the seal ring 137 inwardly. The annular rib 115 of the receptacle 114 is inserted into the annular groove 135 of the jaw 134 while being pressed outwardly by a resilient restoring force of the seal ring 137, and is accommodated in the annular groove 135 while pressing the backlash preventing projections 136.

The fitting projections 151 near the base ends of the respective male terminals 111 reach the entrances of the fitting recesses 154 of the inner housing 123. Fitting projections 151 that are displaced from the fitting recesses 154 will contact the guiding slanted surfaces 157 of the fitting recesses 154 regardless of a direction of displacements. Thus, the guiding slanted surfaces 157 correct the displacements so that and the fitting projections 151 fit into the fitting recesses 154. The projection-side slanted surfaces 153 of the fitting projections 151 and the recess-side slanted surfaces 156 of the fitting recesses 154 are substantially parallel with each other and are held in contact over substantially their entire surfaces. At this time, the rear edges of the projection-side slanted surfaces 153 substantially coincide with the front edges of the recess-side slanted surfaces 156. Additionally, the front edges of the projection-side slanted surfaces 153 at the front ends of the fitting projections 151 are displaced forward from the rear edges of the recess-side slanted surfaces 156 at the rear ends of the fitting recesses 154. Further, the outer peripheral surfaces of the fitting projections 151 and the inner peripheral surfaces of the fitting recesses 154 are in contact.

The projection-side backlash preventing portion 152 between the fitting projections 151 is fit into the recess-side backlash preventing portion 155. Thus, upper and lower surfaces of the projection-side backlash preventing portion 152 and upper and lower surfaces of the recess-side backlash preventing portion 155 are substantially in surface contact. Further, the male terminals 111 are connected with the connecting portions 121A of the female terminals 121.

The two connectors 110, 120 are pushed farther in approaching directions so that the leading end of the receptacle 114 presses the jaw 134. Additionally, the resilient member 144 between the jaw 134 and the facing wall 141 is squeezed and compressed resiliently. The resilient force of the resilient member 144 presses the inner housing 123 forward. Thus, the recess-side slanted surfaces 156 of the fitting recesses 154 are pressed entirely against the projection-side slanted surfaces 153 of the fitting projections 151. Accordingly, the projection-side slanted surfaces 153 move relative to the recess-side slanted surfaces 156 and the front edges of the projection-side slanted surfaces 153 reach the rear edges of the recess-side slanted surfaces 156. As a result, the projection-side slanted surfaces 153 are held firmly in close contact with the recess-side slanted surfaces 156 over their entire surfaces. The minimum diameter of the projection-side slanted surface 153 is larger than that of the recess-side slanted surfaces 156. Hence, the projection-side slanted surfaces 153 are forward of the recess-side slanted surfaces 156 in a state before being pressed by the resilient force, and the projection-side slanted surfaces 153 closely contact the recess-side slanted surfaces 156 when pressed by the resilient force. Accordingly, a situation where the projection-side slanted surfaces 153 are displaced back relative to the recess-side slanted surfaces 156 and only partly held in close contact is prevented even if the projection-side slanted surfaces 153 move relatively forward.

The fitting projections 151 and the fitting recesses 154 could be displaced circumferentially in the rotating direction with respect to the longitudinal direction of the male terminals 111. However, the projection-side and recess-side slanted surfaces 153, 156 are ring-shaped and never fail to be held in contact since the slanted surfaces 153, 156.

The outer housing 138 moves forward relative to the inner housing 123, the terminal tube 123A gradually projects back from the facing wall 141 through the loose insertion hole 143, and the leading end of the lock arm 147 moves onto the lock projection 117 to deform resiliently out.

The leading end of the lock arm 147 moves over the lock 117 when the two connectors are connected properly and the lock arm 147 restores resiliently to engage the lock 117 in forward and backward directions for locking the two connectors 110, 120 together. Thus, the resilient member 144 is held and squeezed resiliently between the jaw 134 and the facing wall 141, and the recess-side slanted surfaces 156 of the fitting recesses 154 and the projection-side slanted surfaces 153 of the fitting projections 151 are held in close contact at plural positions around their surfaces. The resilient member 144 expands along the jaw 134 and the facing wall 141 when pressed between the inner and outer housings 123 and 138. Therefore contract pressures acting on the jaw 134 and the facing wall 141 are distributed to become smaller. Accordingly, there is no need to increase the thicknesses of the jaw 134 and the facing wall 141 as an anti-creep measure and the connector is not enlarged.

The projection-side slanted surfaces 153 and the recess-side slanted surfaces 156 are held in close contact at positions very close to the contact positions of the male terminals 111 and the female terminals 121 (specifically at positions spaced away only by the substantially half the dimension of the connecting portions 121A of the female terminals 121 in forward and backward directions or less). By preventing backlash at such positions, abrasion of the terminals is prevented reliably even if the connector is in an environment subject to vibration. As a result, the connection reliability of the terminals 111, 121 can be higher than before.

The projection-side slanted surfaces 153 and the recess-side slanted surfaces 156 are held closely in surface contact to prevent backlash.

The engagement of the projection-side backlash preventing portion 152 and the recess-side backlash preventing portion 155 prevent vertical backlash at this position, in addition to backlash prevention by the fitting projections 151 and the fitting recesses 154 at the positions near the contact parts of the terminals 111, 121. Therefore, the connection reliability of the terminals 111, 121 can be improved further.

The seal ring 137 is pressed resiliently between the receptacle 114 and the inner housing 123 to provide hermetic sealing therebetween. Additionally, the annular rib 115 engages the backlash preventing ribs 136 of the annular groove 135 by the resilient force of the seal ring 137 to hold the annular rib 115 and the annular groove 135 firmly fixed over substantially the entire periphery. The backlash preventing ribs 128 closely contact the protrusions 116 of the receptacle 114 at the front end of the inner housing 123 to prevent backlash between the inner housing 123 and the receptacle 114 in directions intersecting the connecting direction of the connectors 110, 120. In this way, backlash between the male housing 112 and the inner housing 123 is prevented at both front and rear ends of the inner housing 123 and at both front and rear ends of the contact parts of the two terminals 111, 121. Therefore abrasion of the terminals 111, 121 is prevented even if the connectors 110, 120 are subjected to strong vibration.

The resilient member 144 presses the outer housing 138 backward in the engaging direction of the lock arm 147 with the lock 117 to prevent backlash in forward and backward directions. The outer backlash preventing ribs 128 are pressed between the guide ribs 118 of the receptacle 114 and the guide grooves 145 of the outer housing 138 to prevent backlash between the receptacle 114 and the outer housing 138 and to reduce backlash between the connectors 110, 120. In this way, the connector can withstand high vibration.

As described above, the fitting projections 151 and the fitting recesses 154 are engaged and the inner housing 123 is pressed forward by the resilient restoring force of the resilient member 144 when the two connectors 110, 120 are connected properly. Thus, the projection-side slanted surfaces 153 and the recess-side slanted surfaces 156 are held in close contact to prevent backlash between the fitting projections 151 and the fitting recesses 154. The fitting projections 151 and the fitting recesses 154 are formed at the base ends of the male terminals 111 and the parts where the terminal insertion openings 127 are formed. Thus, backlash is prevented near the contact parts of the terminals 111, 121 and abrasion of the terminals 111, 121 is prevented reliably. Therefore, the connection reliability of the terminals 111, 121 is improved even if the connector is placed in an environment subject to vibration.

The invention is not limited to the above described and illustrated embodiment. For example, the following embodiments are also embraced by the technical scope of the present invention as defined by the claims.

The inner sides of the peripheral surfaces of the respective pass-through openings 26 are flush with the outer circumferential surface of the inner housing 13 and the legs 43 are flush with the inner circumferential surface of the sealing portion 41 in the first embodiment. However, the positions in inward and outward directions and shapes of the pass-through openings 26 do not matter provided that the pass-through openings penetrate the flange in forward and backward directions, and the legs may have any shape provided that they are insertable through the pass-through openings.

The pass-through openings 26 are formed at positions spread around substantially the entire periphery of the inner housing 13 in the first embodiment. However, the invention is not limited thereto and they may be formed only at the upper and lower sides and/or only at the left and right sides.

The backlash preventing portions 44 are formed with the front and rear inclined surfaces 45, 46 in the first embodiment. However, neither of them may be formed or only either of them may be formed.

The pass-through openings 26 are formed with the guiding surfaces 27. However, the guiding surfaces may not necessarily be formed.

Although the flange 23 is formed with the annular groove 24 in the first embodiment, the annular groove need not necessarily be formed.

Although the flange 23 is provided over substantially the entire periphery of the inner housing 13 in the first embodiment, the invention is not limited thereto and it may be interrupted in the peripheral direction.

Although the resilient member 144 is made of rubber in the second embodiment, the invention is not limited thereto and the resilient member may, for example, be made of metal.

The fitting projections 151 are formed at the base ends of the male terminals 111 and the fitting recesses 154 are formed near the terminal insertion openings 127 of the inner housing 123 in the second embodiment. However, the fitting projections and the fitting recesses may conversely be formed near the terminal insertion openings and at the base ends of the male terminals, respectively.

The fitting projections 151 are formed with the projection-side slanted surfaces 153 and the fitting recesses 154 are formed with the recess-side slanted surfaces 156, i.e. both the fitting projections 151 and the fitting recesses 154 are formed with slanted surfaces in the second embodiment. However, the invention is not limited thereto and either the fitting projections or the fitting recesses may be formed with slanted surfaces.

The fitting projections 151 and the fitting recesses 154 are provided in a one-to-one correspondence with the male terminals 111 and the terminal insertion openings 127 in the second embodiment. However, the invention is not limited thereto. For example, one fitting projection covering the base ends of two male terminals and one fitting recess to enclose two terminal insertion openings may be formed. Alternatively, the fitting projections and the fitting recesses may be provided selectively instead of being provided for all of the male terminals and all of the terminal insertion openings.

Although the projection-side slanted surfaces 153 and the recess-side slanted surfaces 156 are substantially C-shaped in the second embodiment, the invention is not limited thereto and the slanted surfaces may be, for example, substantially rectangular.

The minimum diameter of the projection-side slanted surfaces 153 is larger than that of the recess-side slanted surfaces 156 in the second embodiment. However, the invention is not limited thereto. The minimum diameter of the projection-side slanted surfaces may be smaller than or equal to that of the recess-side slanted surfaces 156.

Although the projection-side slanted surfaces 153 and the recess-side slanted surfaces 156 have the same gradient in the second embodiment, they may have different gradients.

Although the projection-side backlash preventing portion 152 and the recess-side backlash preventing portion 155 are provided in the second embodiment, they may not be provided.

Although the backlash preventing ribs 128 are provided on the front side of the inner housing 123 in the above embodiment, they may not necessarily be provided.

The annular rib 115 and the annular groove 135 are at the opening end of the receptacle 114 and the jaw 134 in the second embodiment. However, they may not be provided. Instead, circumferentially interrupted ribs and grooves may, for example, be provided.

Although the backlash preventing projections 136 are in the annular groove 135 in the second embodiment, they may not be provided or may be on the annular rib. Similarly, the outer backlash preventing portions 146 are in the guide grooves 145 of the outer housing 138 in the second embodiment, they may not be provided or may be provided on the guide ribs of the receptacle or may be provided in or on parts of the outer housing and the receptacle other than the guide grooves and the guide ribs.

What is claimed is:

1. A fluidtight connector, comprising:

an inner housing fittable into a receptacle of a mating connector and accommodating at least one terminal;

an outer housing to be assembled with the inner housing for relatively sliding in a connecting direction with the mating connector;

a flange projecting out from an outer peripheral surface of the inner housing and pass-through openings penetrating the flange in the connecting direction with the mating connector;

a facing wall behind the flange with respect to the connecting direction with the mating connector and facing the flange; and a resilient member mounted on the inner housing and including a sealing portion, legs integral to the sealing portion and inserted backward through the respective pass-through openings, backlash preventing portions integral to the legs and at least partly between the flange and the facing wall with respect to the connecting direction with the mating connector, the backlash preventing portions being engaged with peripheral edges of the respective pass-through openings.

2. The fluidtight connector of claim 1, wherein an annular rib is formed at an opening edge of the receptacle and an annular groove is formed in the flange for receiving the annular rib, and at least one projection being formed in the annular groove and configured to be pressed in an inward or outward direction by the annular rib.

3. The fluidtight connector of claim 1, wherein the outer housing includes a lock mechanism engageable with the mating connector substantially in the connecting direction with the mating connector.

4. The fluidtight connector of claim 1, wherein the sealing portion is substantially a tube fittable on a part of the outer peripheral surface of the inner housing before the flange.

5. The fluidtight connector of claim 4, wherein the flange extends substantially entirely around the outer peripheral surface of the inner housing, and the pass-through openings are at plural spaced positions.

6. The fluidtight connector of claim 5, wherein a rear edge of each backlash preventing portion with respect to the connecting direction with the mating connector is formed with a rear inclined surface inclined to reduce a projecting distance from the leg towards the back with respect to the connecting direction.

7. The fluidtight connector of claim 5, wherein a front edge of each backlash preventing portion with respect to the connecting direction with the mating connector is formed with a front inclined surface inclined to reduce a projecting distance from the leg toward the front side with respect to the connecting direction.

8. The fluidtight connector of claim 5, wherein at least one guiding surface is formed at a front peripheral edge of each pass-through opening with respect to the connecting direction with the mating connector and is inclined to widen the pass-through opening towards the front.

9. A connector assembly, comprising:

a first connector with a forwardly open receptacle and at least one first terminal projecting forward from a back surface of the receptacle;

a second connector including an inner housing fittable into the receptacle, an outer housing assembled with the inner housing for relative displacement in the connecting direction and a resilient member mounted between the inner and outer housings and resiliently compressed in the connecting direction between the inner and outer housings when the connectors are connected properly;

fitting portions provided at the first terminal and at the inner housing, the fitting portions being engageable with each other substantially in the connecting direction when the two connectors are connected properly, at least one of the fitting portions being formed with at least one slanted surface inclined with respect to the connecting direction at a part to be held in contact with the mating fitting portion when the fitting portions engaged with each other.

10. The connector assembly of claim 9, wherein the inner housing is formed with at least one cavity accommodating at least one second terminal connectable with the first terminal and at least one terminal insertion opening at a front end of the cavity with respect to the connecting direction for receiving for receiving the first terminal, and the fitting portions are provided at a base end of the first terminal on the back surface of the receptacle and at a part of the inner housing where the terminal insertion opening is formed.

11. The connector assembly of claim 9, wherein both fitting portions are formed with slanted surfaces, and both slanted surfaces have the substantially same gradient.

12. The connector assembly of claim 9, wherein at least one backlash preventing portion is provided between adjacent fitting portions for preventing backlash in a direction intersecting a juxtaposing direction of the fitting portions by engaging each other when the two connectors are connected properly.

13. The connector assembly of claim 9, wherein at least one backlash preventing rib is provided substantially at the front end of the inner housing with respect to the connecting direction for contacting the receptacle when the two connectors are connected properly.

14. The connector assembly of claim 9, wherein the resilient member is made of rubber.

15. The connector assembly of claim 9, wherein a plurality of the first terminals and a plurality of the terminal insertion openings are provided at corresponding positions, and the fitting portions are provided in a one-to-one correspondence with the first terminals and the terminal insertion openings.

16. The connector assembly of claim 15, wherein the outer housing is fittable on or in the receptacle, and at least one outer backlash preventing portion is provided between the outer housing and the receptacle for preventing backlash between the outer housing and the receptacle.

17. The connector assembly of claim 9, wherein the slanted surface is substantially ring-shaped around the first terminal and the terminal insertion opening.

18. The connector assembly of claim 17, wherein a minimum diameter of the slanted surface of one of the fitting portions is larger than that of the slanted surface of the other fitting portion.

19. The connector assembly of claim 9, wherein at least one jaw projects from a position on the inner housing in proximity to the rear end of the inner housing with respect to the connecting direction, the jaw projecting substantially orthogonal to the connecting direction and substantially facing the opening end of the receptacle, and at least one annular backlash preventing portion provided at the jaw or the opening end of the receptacle for engaging each other when the two connectors are connected properly to prevent backlash.

20. The connector assembly of claim 19, wherein a seal ring is mounted on the front end of the outer surface of the inner housing before the jaw with respect to the connecting direction by being pressed between the inner housing and the receptacle to provide sealing between the inner housing and the receptacle, and backlash preventing projections are provided on contact surfaces of the annular backlash preventing portions at an outer circumferential side.

* * * * *